United States Patent [19]

Barby et al.

[11] 4,448,704

[45] May 15, 1984

[54] ARTICLE SUITABLE FOR WIPING HARD SURFACES

[75] Inventors: Donald Barby, Great Barrow; David E. Clarke, Bromborough; John Lloyd, Higher Bebington; Zia Haq, Spital, all of England

[73] Assignee: Lever Brothers Company, New York, N.Y.

[21] Appl. No.: 381,612

[22] Filed: May 24, 1982

[30] Foreign Application Priority Data

May 29, 1981 [GB] United Kingdom ..... 8116438

[51] Int. Cl.[3] ..... C11D 17/04

[52] U.S. Cl. ..... 252/91; 252/162; 252/173; 252/174.23; 252/DIG. 2; 252/DIG. 10; 15/104.93

[58] Field of Search ..... 252/91, 162, 168, 170, 252/173, DIG. 10, 174.23, DIG. 2; 15/104.93

[56] References Cited

U.S. PATENT DOCUMENTS

| | | | |
|---|---|---|---|
| 3,696,043 | 10/1972 | Labarge et al. | 252/153 |
| 3,711,884 | 1/1973 | Feig | 15/104.93 |
| 3,897,356 | 7/1975 | Pociluyko | 252/91 |
| 3,954,642 | 5/1976 | Schwuger | 15/104.93 |
| 3,965,518 | 6/1976 | Muoio | 15/104.93 |
| 4,054,534 | 10/1977 | Angelini | 252/162 |
| 4,096,311 | 6/1978 | Pietreniak | 428/289 |
| 4,178,407 | 12/1979 | Rubens | 428/284 |
| 4,189,395 | 2/1980 | Bland | 252/91 |
| 4,213,873 | 7/1980 | Church | 252/174.21 |
| 4,276,338 | 6/1981 | Ludwa et al. | 428/137 |

FOREIGN PATENT DOCUMENTS

| | | |
|---|---|---|
| 1849 | 5/1979 | European Pat. Off. . |
| 6647 | 1/1980 | European Pat. Off. . |
| 14501 | 8/1980 | European Pat. Off. . |
| 58633 | 8/1982 | European Pat. Off. . |
| 66342 | 12/1982 | European Pat. Off. . |
| 2259138 | 6/1974 | Fed. Rep. of Germany . |
| 2519745 | 11/1976 | Fed. Rep. of Germany . |
| 2840464 | 4/1980 | Fed. Rep. of Germany . |
| 2849977 | 5/1980 | Fed. Rep. of Germany . |
| 47-20232 | 6/1972 | Japan . |
| 50-48750 | 5/1975 | Japan . |
| 1126479 | of 0000 | United Kingdom . |
| 1304375 | 1/1973 | United Kingdom . |

*Primary Examiner*—John E. Kittle
*Assistant Examiner*—Hoa Van Le
*Attorney, Agent, or Firm*—Milton L. Honig; James J. Farrell

[57] ABSTRACT

An article is disclosed which is suitable for wiping hard surfaces such as glass to give a streak-free finish. The article comprises a substrate (preferably paper or non-woven fabric) carrying a homogeneous aqueous composition having a surface tension below 45 $mNm^{-1}$ and which on drying does not form discrete droplets or particles larger than 0.25 $\mu m$. The liquid composition advantageously includes a (preferably nonionic) surface-active agent and a partially esterified resin such as a partially esterified styrene/maleic anhydride copolymer. The article may be wet (for example, coated or impregnated with the liquid composition) or dry up to the point of use (for example, the liquid may be within pressure-rupturable microcapsules). Preferably the article is produced by a process which includes prewashing the substrate to remove any potentially streak-forming impurities.

17 Claims, No Drawings

ARTICLE SUITABLE FOR WIPING HARD SURFACES

The present invention relates to an article suitable for wiping a hard glossy surface to give a substantially streak-free result. The article of the invention is in the form of a substrate, for example, a sponge, sheet or pad, carrying a liquid composition which when applied to the surface and allowed to dry leaves the surface substantially free of streaks. The article of the invention may, for example, be used for wiping the various reflective surfaces encountered in the home such as glass (windows and mirrors), wall and floor tiles, linoleum and other floor coverings, gloss paintwork, and kitchen and bathroom furniture and fittings. It is also useful for wiping car windows, especially the windscreen.

Various compositions have been proposed for cleaning hard surfaces. There are usually provided in the form of a particulate composition, from which the user prepares an aqueous solution, or in the form of a liquid composition which contains a suitable solvent, such as water or an organic solvent, or a mixture of these. These liquids can be applied either neat or in the form of a more dilute solution. However, despite the fact that many of such general-purpose cleaning compositions often satisfactorily remove soil and dirt from hard surfaces, they often leave behind residues once the solvent medium has evaporated during the drying of the cleaned surface. It is often necessary for the surface to be immediately dried and polished using a dry cloth. If the surface is left to dry naturally it presents residues, visible as dull streaks, instead of the bright, shining surface that the consumer wants to see.

When the consumer applies such a composition to a surface by means, for example, of a cloth or tissue, there is an opportunity for the composition to be contaminated by impurities present on the cloth or tissue; such impurities can be left on the surface as streaks. If the user has to prepare the composition himself by diluting a concentrate, there is a further opportunity for contamination from the vessel (e.g. a bucket) in which the mixing is done; furthermore, if hard water is used for the dilution, the water hardness provides a further source of streaking. Thus, even when the cleaning composition itself is formulated so as to give a streak-free result under optimum conditions, it is frequently impossible to achieve a streak-free surface in practice.

According to the invention there is provided an article suitable for wiping hard surfaces to give a substantially streak-free result, the article comprising (a) a flexible substrate substantially free of streak-forming impurities, carrying (b) a homogeneous aqueous liquid composition having a surface tension of less than 45 $mNm^{-1}$, preferably less than 35 $mNm^{-1}$, which composition, when applied to a surface and allowed to dry, dries substantially without forming discrete droplets or particles larger than 0.25 $\mu m$.

The formation of discrete droplets or particles larger than 0.25 $\mu m$ on drying causes scattering of visible light (wavelength 0.4–0.7 $\mu m$), which is perceived by the eye as streaking.

Preferably the liquid composition dries substantially without forming discrete droplets or particles larger than 0.1 $\mu m$.

The article of the invention has the major advantage that it can be applied directly to the surface to be cleaned; a lightly soiled surface need only be wiped over with the article of the invention and then allowed to dry. No additional liquid and no cloths or tissues are required; thus contamination by streak-forming impurities is eliminated. The article of the invention is highly suitable for wiping lightly soiled surfaces, such as mirrors, kitchen unit doors or glass-topped tables, to leave them shining and streak-free.

The article of the invention comprises a substrate carrying a liquid composition, and it may conveniently take the form of an absorbent substrate impregnated with the liquid composition. The substrate may be, for example, a sponge or pad, or a flat flexible sheet of paper or woven, knitted or nonwoven fabric. If in sheet form, the substrate may consist of just a single layer, or it may be in the form of a laminate, for example as disclosed in EP No. 14501, EP No. 1849 or U.S. Pat. No. 4,276,338 (Proctor & Gamble) or EP No. 6647 (Buckeye Cellulose Corporation). The substrate, if multilayer, may if desired include an inner layer of material impermeable to the liquid composition, as described, for example, in U.S. Pat. No. 4,178,407 (Proctor & Gamble).

If a single layer sheet substrate is used, it is preferably of paper (which must of course, have sufficient wet strength) or of nonwoven fabric. The base weight of the substrate is preferably from 20 to 100 $g/m^2$.

Preferably the substrate is not so open in structure that contact can occur in use between the fingers and the surface being wiped, such contact can cause streaking because of contamination by sebum or greasy soil from the hand. The higher the base weight, the more porous the structure can be without allowing hand contact. Wet-laid nonwoven fabrics, which include paper, are preferred in this regard as they are generally made from relatively short fibres and the process of manufacture tends to lead to compaction. Low base weight nonwoven fabrics made by air laying or carding, which are generally made from longer fibres and have higher porosities, are more susceptible to the hand interference problem, but the problem can be circumvented with these materials by using larger area substrates which will always be folded or balled by the consumer before use.

The area of the substrate is preferably at least 0.03 $m^2$, more preferably at least 0.08 $m^2$, for a material not susceptible to the hand interference problem, for example, a creped wet-strength paper. For a low base weight porous nonwoven fabric, an area of at least 0.1 $m^2$ is preferred.

The minimum quantity of liquid that can be carried by an absorbent substrate is determined by its capacity to hold onto liquid within its fibre structure under typical hand wiping pressures; this is termed the (water) retention value. This liquid is not available for cleaning the surface. The maximum quantity of liquid that can be carried is determined by the total capacity of the substrate to carry water without dripping into its packaging or container. The liquid available for cleaning the surface is, of course, the difference between these maximum and minimum capacities.

Advantageously the substrate has a maximum water capacity of from 1.5 to 15 g/g, and its retention value is preferably at least 0.25 g/g, more preferably from 0.5 to 1.0 g/g.

The total loading of the liquid composition on the substrate in the article of the invention is preferably within the range of from 0.5 to 10 grams per gram of substrate, more preferably from 1.0 to 2.0 grams per gram. For a substrate in sheet form, the loading in practice preferably amounts to from 5.0 to 3.0 times the base weight of the substrate, preferably 1.0 to 2.5 times the base weight and desirably 1.5 to 2.0 times the base weight.

Some examples of commercially available substrates suitable for use in the article of the invention are shown in Table 1. Of those materials, Gessner Duftex 04 (a wet-strength paper), Storalene 544-50 (a wet-laid nonwoven fabric) and Dexter R 196-G5343 (a wet-laid nonwoven fabric) are especially preferred; these materials all have nominal base weights of 50 g/m$^2$.

It is an essential feature of the invention that the substrate be substantially free of streak-forming impurities which might be leached out by the liquid composition and deposited on the wiped surface as streaks. Some substrates may inherently be free of such impurities; many papers or nonwoven fabrics, however, contain binders and some of these can cause streaking problems. Traces of bonding agent, size, clays, fluorescers, fibre lubricants, emulsifiers or other processing materials may also be present in papers and nonwoven fabrics and these can also cause streaking.

TABLE 1

| Substrate type | Base wt. (g/m$^2$) | Fibre mix | Binder type | Water capacity (g/g) | Water retention value (g/g) | Trade Name (*denotes Trademark) | Manufacturer |
|---|---|---|---|---|---|---|---|
| Wet-strength creped paper | 50 | softwood pulp | crosslinked katpoly-alkylimine | 3.0 | 1.0 | Gessner* Duftex* 04 | Gessner (Germany) |
| Wet-strength creped paper | 85 | softwood pulp and cotton linters | melamine wet-strength resin | 2.7 | 1.1 | Wiggins-Teape* 85 | Wiggins-Teape (UK) |
| Wet-strength high loft paper | 85 | wood pulp/ viscose? | acrylic | 6.7 | 0.82 | Hi-loft* PO/1615 | Scott Paper Co. (USA) |
| Wet-laid nonwoven | 50 | viscose and wood pulp | not known | 4.3 | 0.5 | Dexter* R196-G5343 | Dexter (UK) |
| Wet-laid nonwoven | 50 | viscose (80%) and wood pulp (20%) | acrylic | 6.3 | 0.88 | Tampella* K 286 | Tampella (Sweden) |
| Wet-laid nonwoven | 60 | viscose (55%) cotton linters (40%) polyamide (5%) | acrylic or vinyl acetate | 6.2 | 0.8 | Storalene* 610:60 | Stora-Copparberg (Sweden) |
| Wet-laid nonwoven | 50 | Probably as above | vinyl acetate | 4.2 | 0.8 | Storalene* 544.50 | Stora-Copparberg (Sweden) |
| Dry-laid nonwoven | 60 | viscose and wood pulp | acrylic or styrene-butadiene resin | 7.7 | 0.67 | Honshu* P 60 | Honshu Paper Co. (Japan) |
| Dry-laid nonwoven | 25 | viscose | acrylic | 5.5 | 0.63 | PHM 25 | Bonded Fibre Fabrics (UK) |
| Spun-bonded nonwoven | 44 | polyester | none | 5.5 | 0.27 | Sontara* 8000 | Du Pont (USA) |

Accordingly the substrate is preferably pretreated to remove any materials associated therewith that might cause, or contribute to, streaking.

The treatment may conveniently comprise prewashing the substrate with a solvent capable of removing the impurities, before the application of the liquid composition. In some cases washing with hot to boiling demineralised water may be necessary, while in others a presoaking in an excess of the liquid composition itself may suffice.

Some binders used in paper and nonwoven fabrics, notably crosslinked katpolyalkylimine, do not appear to cause streaking problems, and substrates in which only this type of binder is present may not require a prewashing treatment.

The liquid cleaning composition carried by the substrate is in the form of a homogeneous aqueous solution. As well as water it may contain one or more water-miscible solvents, but the amount of non-aqueous solvent generally should not exceed 35% by weight, and is preferably within the range of from 0.1 to 15% by weight. Larger amounts of solvent can cause safety problems and may damage certain surfaces such as plastics or paintwork; the presence of limited amounts of solvent is however advantageous in decreasing the drying time of the composition and in facilitating the removal of oily soil.

Typical examples of suitable solvents are the lower aliphatic water-miscible alcohols such as ethanol, propanol, isopropanol, butanol and so on. Other alcohols, such as tetrahydrofurfurol, may also be used. Glycols such as ethylene- and propylene glycol and glycol ethers, such as the mono- and dimethyl-, -propyl, -isopropyl, -butyl, -isobutyl ethers of di- and triethylene glycol and of analogous propylene glycols may also be used. The preferred solvents are $C_2$ and $C_3$ aliphatic alcohols, especially ethanol and isopropanol. The cellosolves and carbitols are also useful solvents in the context of the invention.

It will be recalled that the liquid cleaning composition carried by the substrate is required to have a surface tension of less than 45 mNm$^{-1}$, and preferably less than 35 mNm$^{-1}$, in order adequately to wet the surface being wiped. The lowering of surface tension (the value for water is above 70 mNm$^{-1}$) is conveniently achieved by including in the liquid a surface-active agent, preferably at a concentration not exceeding 1.5% by weight. Higher concentrations are unnecessary from the point of view of surface tension lowering and may cause streaking or excessive sudsing. A concentration within the range of from 0.009 to 1% by weight is preferred, and one within the range of from 0.02 to 0.2% by weight is especially preferred.

Although in principle any anionic, nonionic, cationic, zwitterionic or amphoteric surface-active agent may be used, nonionic surface-active agents, which tend to be low-foaming, are especially preferred. In general, nonionic surface-active agents consist of a hydrophobic moiety, such as $C_8$–$C_{20}$ primary or secondary, branched or straight chain monoalcohol, a $C_8$–$C_{18}$ mono- or dialkyphenol, a $C_8$–$C_{20}$ fatty acid amide, and a hydrophilic moiety which consists of alkylene oxide units. These nonionic surface-active afgents are for instance alkoxylation products of the above hydrophobic moieties, containing from 2 to 30 moles of alkylene oxide. As alkylene oxides ethylene-, propylene- and butylene oxides and mixtures thereof are used.

Typical examples of such nonionic surfactants are $C_9$–$C_{11}$ primary, straight-chain alcohols condensed with from 5–9 moles of ethylene oxide, $C_{12}$–$C_{15}$ primary straight-chain alcohols condensed with from 6–12 moles of ethylene oxide, or with 7–9 moles of a mixture of ethylene- and propylene oxide, $C_{11}$–$C_{15}$ secondary alcohols condensed with from 3–15 moles of ethylene oxide, and $C_{10}$–$C_{18}$ fatty acid diethanolamides. Tertiary amine oxides such as higher alkyl di(lower alkyl or lower substituted alkyl)amine oxides, for example, lauryl di(hydroxymethyl)amine oxides, are also suitable nonionic surfactants for use in the article of the invention. Further examples may be found in N. Schick's textbook "Nonionic Surfactants", M. Dekker Inc, New York, 1967. Mixtures of various nonionic surfactants may also be used.

For optimum detergency, the shorter alkyl chain length nonionic surfactants are preferred, particularly when the degree of alkoxylation is relatively low. Thus, the alkoxylated $C_9$–$C_{11}$ alcohols are preferred over the corresponding alkoxylated $C_{12}$–$C_{15}$ alcohols, and the $C_9$–$C_{11}$ alcohols condensed with 5 moles of ethylene oxide are preferred over the same alcohols but condensed with 8 moles of ethylene oxide.

A class of nonionic surfactants that give good streak-free results is comprised by the condensation products of $C_{16}$–$C_{20}$ alcohols with 15 to 20 moles of ethylene oxide. The condensation product of tallow alcohol with 18 moles of ethylene oxide is especially effective.

Anionic surfactants may also be used in the liquid composition of the article of the invention, but since these generally tend to foam more than nonionic surfactants they are generally used in smaller amounts, preferably in concentrations not exceeding 0.15% by weight. Foaming is disadvantageous because foam can leave spots as it dries.

Preferred anionic surfactants for use according to the invention are the alkyl ether sulphates, especially the sulphated condensation products of $C_{10}$–$C_{18}$ aliphatic alcohols with 1 to 8 moles of ethylene oxide. Secondary alkane sulphonates, alkylbenzene sulphonates, soaps, dialkyl sulphosuccinates, primary and secondary alkyl sulphates, and many other anionic surfactants known to the man skilled in the art, are also possible ingredients.

It will further be recalled that the liquid composition dries, after application to a surface, substantially without the formation of discrete droplets or particles larger than 0.25 μm, and preferably without the formation of such droplets or particles larger than 0.1 μm. It is the formation of such particles or droplets, which scatter visible light, which produces streaks on the surface. Avoidance of streak formation on drying may be assisted by including in the liquid composition a film-forming component, preferably but not exclusively an organic film-forming polymer.

Examples of materials promoting streak-free drying include polyethylene glycols; see, for example, German Auslegeschrift No. 28 40 464 (Henkel); German Offenlegungsschrift No. 28 49 977 (Henkel); and U.S. Pat. No. 4,213,873 (Leisure Products Corp).

Polysiloxanes have also been used for this purpose; see, for example, Japanese Patent Application No. 72 20232 (Asahi Glass Co. Ltd).

One example of a liquid composition suitable for use in the article of the present invention is described in U.S. Pat. No. 3,696,043 (Dow), which discloses a cleaning composition for glass and reflective surfaces comprising a solution of about 0.01 to 5% by weight of an anionic or nonionic detergent and about 0.03 to 2% by weight of a soluble salt of a copolymer of a monovinyl aromatic monomer and an unsaturated dicarboxylic acid or an anhydride thereof.

According to a highly preferred embodiment of the invention, however, the liquid composition contains a partially esterified resin as specified in our British Patent Application No. 81 1439. This Application relates to a general purpose cleaning composition with improved non-streak and cleaning properties, comprising, in a compatible liquid medium, a nonionic surfactant and an at least partially esterified resin. In the article of the present invention, the resin may be used either alone or in conjunction with a surface-active agent.

The at least partially esterified resin preferably used in the article of the present invention can be either partly derived from natural sources or wholly synthetic in origin. An example of a resin partly derived from natural sources is the partially esterified adduct of rosin and an unsaturated dicarboxylic acid or anhydride.

Examples of wholly synthetic resins are partially esterified derivatives of copolymerisation products of mono-unsaturated aliphatic, cycloaliphatic or aromatic monomers having no carboxy groups, copolymerised with unsaturated dicarboxylic acids or anhydrides thereof. Normally, these copolymers will contain equimolar proportions of the monomer and the dicarboxylic acid or anhydride, but copolymers with higher ratios of monomer per mole of dicarboxylic acid or anhydride are also suitable, provided that they can be dissolved in the aqueous solvent system used.

Typical examples of suitable copolymers are copolymers of ethylene, styrene, and vinylmethylether with maleic acid, fumaric acid, itaconic acid, citraconic acid, aconitic acid and the like and the anhydrides thereof. Preferred are the styrene/maleic anhydride copolymers.

The partly natural or wholly synthetic resins are at least partially esterified with a suitable hydroxyl-group-containing compound. Examples of suitable compounds are aliphatic alcohols such as methanol, ethanol, propanol, isopropanol, butanol, isobutanol, ethylhexanol and decanol, glycol ethers such as the butyl ether of ethylene glycol and polyols such as ethyleneglycol, glycerol, erythritol, mannitol, sorbitol, polyethylene glycol, polypropylene glycol; and the hydroxylic nonionic surfactants mentioned above. The choice of suitable esterification agent and the degree of esterification are primarily governed by the solubility requirements of the at least partially esterified resin in an aqueous or aqueous/solvent system of the type previously described, which will generally be alkaline.

In the at least partially esterified resin, the degree of esterification is preferably such that from 5 to 95%, more preferably from 10 to 80%, and especially 20 to 75%, of the free carboxy groups of the resin are esterified with the hydroxyl-group-containing compound. The esterification may also be complete.

Suitable examples of preferred partially esterified resins are partially esterified copolymers of styrene with maleic anhydride, for example, Scripset (Trade Mark) 550 (ex Monsanto, U.S.A.); partially esterified adducts of rosin with maleic anhydride for example, SR 91 (ex Schenectady Chemicals, U.S.A.); modified polyester resins, for example, Shanco (Trade Mark) 334 (ex Shanco Plastics); and polyvinyl methylether/maleic anhydride copolymers partially esterified with butanol, for example, Gantrez (Trade Mark) ES 425 (ex GAF Corporation, U.S.A.).

Mixtures of various partially esterified resins may also be used, as well as mixtures of partially esterified and fully esterified or non-esterified resins. Thus, mixtures of Scripset 550 and SR 91, Scripset 550 and Shanco 334, and SR 91 and Shanco 334 gives good results, as well as mixtures of Scripset 550 and SMA 2000A (a non-esterified styrene/maleic anhydride copolymer ex Arco Chemical Co., U.S.A.).

The molecular weight of the resins used according to the invention may vary from about a few thousand to about a few million. The partially esterified resins should have acid numbers high enough to ensure solubility in a neutral or alkaline aqueous medium. The partially esterified resin may if necessary be hydrolysed and subsequently neutralised or made alkaline so that in normal use it is present in the cleaning compositions on the wipe of the invention as the alkali metal, ammonium or substituted ammonium salt, or as the salt of a suitable amine or mixtures thereof.

The concentration of the film-forming resin in the liquid composition is preferably within the range of from 0.001 to 5% by weight, more preferably from 0.005 to 1% by weight. At the higher levels the resin alone may be sufficient to lower the surface tension of the composition below the limiting value of 45 $mNm^{-1}$.

It is preferred, however, to use both a surface-active agent, preferably nonionic or nonionic plus anionic, and a film-forming resin. In this case the weight ratio of surfactant to resin preferably lies within the range of from 15:1 to 1:2, more preferably 10:1 to 1:1.

In liquid compositions containing surface-active agents and film-forming resins, it has been found that antiresoiling benefits may be obtained by including in these compositions certain cellulose derivatives, notably hydroxymethyl, hydroxyethyl and carboxymethyl celluloses. These materials are generally included in amounts comparable to the amount of resin present. In repeated clean/soil cycles it has been found that the build up of soil on the wiped surface can be reduced to some extent by this measure.

The liquid composition carried by the article of the invention contains water, generally in substantial amounts. In most preferred systems it contains at least 80% water, and preferably at least 90%. In systems containing no non-aqueous solvent the water content is preferably at least 95% and may be as much as 99% or more. It is generally preferred to use demineralised water in order to minimise the possibility of streak-forming impurities; where calcium-sensitive active ingredients such as certain anionic surfactants (notably soaps and alkylbenzene sulphonates) are present this is especially important.

Accordingly it will not generally be necessary to include a builder in the liquid composition, although the presence of most soluble builders does not, apparently, cause streak formation.

On the other hand, with some active ingredients, streak-free drying is actually promoted by the hardness impurities in water. Certain nonionic surfactants, for example, when used alone in demineralised water give streaking because on drying a mist of droplets is formed. When hard water is used instead of demineralised water, however, streak-free drying can be achieved.

In addition to the various components already specified, the liquid composition on the articles of the invention may if desired contain further, optional ingredients, such as preservatives, colouring agents, perfumes and plasticizers, with, of course, the proviso that such materials do not interfere with the streak-free drying properties of the composition.

If the article of the invention is of the wet impregnated type it must of course be packaged in such a way that loss of volatile material in the cleaning composition by evaporation is substantially eliminated. The articles may, for example, be packaged individually in moisture-proof sachets, for example, of metal foil and/or plastics film. Alternatively, a continuous roll of wet substrate, perforated at intervals, can be packaged in a container with a tight closure, as is known, for example, for various personal cleaning and baby-cleaning wipes currently on the retail market.

It is also within the scope of the invention for the article to be dry up to the point of use, that is to say, with the liquid composition held or encapsulated in some way and then released at the point of use by the application of pressure. This arrangement has the advantage that no precautions need be taken to avoid loss of moisture during packaging and storage, and simple packaging as is customary for paper towels and tissues may be adequate.

The liquid may, for example, be contained in pressure-rupturable microcapsules distributed through or coated onto the substrate. An article of this general construction, for cosmetic use, is described in British Patent Specification No. 1,304,375 (L'Oréal). If the microcapsules are included in the stock from which the substrate is made, they will be distributed throughout the substrate; alternatively microcapsules may be coated onto a preformed substrate.

Alternatively, the liquid may be held within a porous polymer, as described in our British patent application No. 8,119,739. A thin layer of porous polymer may, for example, be positioned between two layers of absorbent sheet substrate sealed together at their edges; or a block of polymer may be surrounded with a layer of plastics foam, sponge material, or the like. Other arrangements will readily suggest themselves to one skilled in the art.

As mentioned previously, in use the article of the present invention is simply passed over the surface to be treated, which is then left to dry. No water is added, and no subsequent polishing with a dry cloth is necessary.

The invention is further illustrated by the following non-limiting Examples.

EXAMPLES 1-5

A liquid composition was made up as follows:

| | % |
|---|---|
| Nonionic surfactant: $C_9$—$C_{11}$ primary straight-chain alcohol condensed with 5 moles of ethylene oxide (Dobanol 91-5 ex Shell) | 0.095 |
| Partially esterified resin:partial ester of a styrene-maleic anhydride copolymer, neutralised to the sodium salt (average molecular weight 10 000; theoretical acid number 190). (Scripset 550 ex Monsanto) | 0.01 |
| Demineralised water | to 100 |

Pieces of the substrates listed below, each having an area of 0.1 $m^2$ (30×33.3 cm), were washed in boiling demineralised water, rinsed in cold demineralised water and allowed to dry. Each washed substrate was impregnated with the liquid composition above, to a loading of 90 $g/m^2$, equal to 1.8 times the base weight of the substrate. Corresponding controls using unwashed substrate pieces were also prepared.

Each article was then wiped once over the whole surface of a clean black glazed ceramic tile, and the tiles were then allowed to dry naturally. The results are shown in Table 2, and demonstrate the importance of prewashing the substrate to remove potentially streak-forming impurities.

TABLE 2

| | Substrate | | | | Streaking results | |
|---|---|---|---|---|---|---|
| Example | Type | Base weight ($g/m^2$) | Binder type | Trade Name | Washed substrates | Unwashed substrates |
| 1 | Wet-strength creped paper | 50 | crosslinked katpolyalkyl-imine | Gessner-Duftex 04 | No streaks | light streaks |
| 2 | Wet-strength creped paper | 85 | melamine wet strength resin | Wiggins-teape 85 | No streaks | very light streaks |
| 3 | Wet-laid viscose/wood pulp non-woven | 50 | acrylic | Tampella K 286 | A few fine streaks | streaks |
| 4 | Wet-laid viscose/ cotton/ polyamide nonwoven | 60 | acrylic | Storalene 610-60 | A few fine streaks | patchy streaks |
| 5 | Spun-bonded polyester nonwoven | 44 | none | Sontara 8000 | No steaks | fine streaks |

EXAMPLES 6–10

The test of Examples 1–5 was repeated using a different prewashing procedure for the substrates. Instead of using demineralised water, the substrates were soaked in the liquid composition, excess liquid was removed by passing the substrates between rollers, and they were then impregnated with fresh liquid from a different bath. The streaking test was carried out as described above and similar results were obtained.

EXAMPLES 11–13

Three pieces of the substrate used in Example 1 (wet-strength creped paper with crosslinked katpolyalkylimine binder, base weight 50 $g/m^2$) were impregnated to three different loadings with the liquid composition given above, and tested as described above for streaking on a black tile.

The results were as follows:

| | Loading of liquid composition | | |
|---|---|---|---|
| Example | $g/m^2$ | as multiple of base weight | Streaking results |
| 11 | 86 | 1.72 | no streaks |
| 12 | 105 | 2.10 | no streaks |
| 13 | 120 | 2.40 | light streaks |

This shows that streaking can occur if the loading of liquid on the substrate is too high.

EXAMPLES 14–22

This Example shows the effect of the concentration of the liquid composition and the loading level on streaking. The procedure of Examples 11 to 13 was repeated using three more concentrated liquid compositions containing the same ingredients. The results are shown in Table 3. It is apparent that the lower the concentration of the active ingredients in the liquid, the higher the loadings that can be tolerated before streaking occurs.

TABLE 3

| | Liquid composition | | | Loading | | |
|---|---|---|---|---|---|---|
| Example | Nonionic surfactant (%) | Resin (%) | $g/m^2$ | as multiple of base weight | Streaking results |
| 14 | 0.19 | 0.02 | 80 | 1.60 | no streaks |
| 15 | " | " | 84 | 1.68 | slight spotting |
| 16 | " | " | 86 | 1.72 | light streaks |
| 17 | 0.38 | 0.04 | 67.5 | 1.35 | no streaks |
| 18 | " | " | 79 | 1.58 | very light streaks |
| 19 | " | " | 81.5 | 1.63 | light streaks |
| 20 | 0.76 | 0.08 | 62 | 1.24 | no streaks |
| 21 | " | " | 68 | 1.36 | very light streaks |
| 22 | " | " | 79.5 | 1.59 | light streaks |

EXAMPLE 23

An article prepared as in Example 1, with a washed substrate, was passed over a large lightly-soiled interior window until exhausted. The area that could be cleaned to give a streak-free finish using a single article was found to be approximately 2 $m^2$.

EXAMPLE 24

A liquid composition corresponding to that used in Examples 1 to 5 was prepared using, instead of Scripset 550 resin, a vinyl methyl ether/maleic anhydride copolymer partially esterified with butanol (Gantrez ES 425 ex GAF Corporation). The composition was tested for streaking using the substrate and procedure of Example 1 and gave no streaks. Use of the washing procedure of Example 6 instead of that of Example 1 also gave no streaks. With an unwashed substrate light streaking occurred.

EXAMPLES 25–34

A range of nonionic surfactants, each at a concentration of 0.1% by weight in demineralised water, was tested for streaking on prewashed substrates according to Example 1 (wet-strength creped paper, 50 g/m$^2$) at a loading of 90 g/m$^2$ (i.e. 1.8 times the base weight). The results obtained are shown in Table 5.

While all the surfactants lowered the surface tensions of their solutions to the requisite extent, it is clear that not all these solutions dried without the formation of particles or droplets of light-scattering size when no other components were present.

TABLE 5

| Example | Nonionic Surfactant Chemical type | Streaking results |
|---|---|---|
| 25 | Tallow alcohol ($C_{18}$), 18 EO | No streaks |
| 26 | $C_{13}$—$C_{15}$ oxo alcohol, 20 EO | " |
| 27 | Nonyl phenol 18 EO | " |
| 28 | Nonyl phenol 30 EO | " |
| 29 | Nonyl phenol 9.5 EO | Light streaks |
| 30 | Nonyl phenol 8 EO | " |
| 31 | $C_9$—$C_{11}$ linear primary alcohol, 5 EO | " |
| 32 | $C_{15}$ (average) linear secondary alcohol, 15 EO | " |
| 33 | $C_{14}$—$C_{15}$ linear secondary alcohol, 7 EO | Medium streaks |
| 34 | $C_{12}$—$C_{14}$ linear primary alcohol, 3 EO | Heavy streaks |

EXAMPLES 35 & 36

An anionic surfactant—a $C_{12}$–$C_{14}$ alkyl ether (3 EO) sulphate—was tested by the procedure of Examples 25 to 34 and was found to give no streaking. The material used was Empicol (Trade Mark) ESB 70 ex Albright & Wilson (UK).

Similarly a $C_{10}$–$C_{12}$ linear alkylbenzene sulphonate (Dobs (Trade Mark) 102 ex Shell) at a concentration of 0.06% gave no streaking.

EXAMPLE 37

A 0.1% solution of the nonionic surfactant Synperonic (Trade Mark) 7 EO (ex ICI) in demineralised water was found to give substantial streaking under the conditions of Examples 25 to 36. However a 10% solution of the surfactant diluted to 0.1% in water of 40° French hardness (32° Ca, 8° Mg) gave a substantially streak-free result under the same conditions. Synperonic 7 EO is the condensation product of a $C_{13}$–$C_{15}$ oxo alcohol (about 40–50% branched) with 7 moles of ethylene oxide.

It would appear that with some surfactants streak-free drying is promoted by the hardness impurities in water.

EXAMPLES 38 & 39

Two liquid compositions containing high foaming anionic surfactants at low concentration were prepared from the following ingredients:

| | Example 38 (%) | Example 39 (%) |
|---|---|---|
| $C_{10}$—$C_{12}$ linear alkylbenzene sulphonate (Dobs 102 ex Shell) | 0.05 | 0.12 |
| $C_{12}$—$C_{15}$ alkyl ether sulphate 3 EO (Dobanol 25 ex Shell) | 0.05 | 0.03 |
| Magnesium sulphate | 0.008 | — |
| Demineralised water to 100% | | |

When tested under the conditions of Example 1 (using washed substrates) both compositions gave substantially no streaking, although the composition of Example 38 left some spots from sudsing.

EXAMPLE 40

The following composition containing both anionic and nonionic surfactants and a non-aqueous solvent (ethanol) was prepared:

| | % |
|---|---|
| Sodium di(2-ethylhexyl) sulphosuccinate | 0.12 |
| $C_{11}$—$C_{15}$ secondary alcohol, 12 EO | 0.09 |
| Ethanol | 0.13 |
| Demineralised water | to 100 |

When tested under the conditions of Example 1 (using a washed substrate), this composition gave a streak-free result.

EXAMPLE 41

The following composition containing a single nonionic surfactant and a relatively high proportion of a non-aqueous solvent (isopropanol) was prepared:

| | % |
|---|---|
| Tallow alcohol 18 EO | 0.1 |
| Isopropanol | 10.0 |
| Ammonia (35% solution) | to pH 10 |
| Demineralised water | to 100 |

It has already been shown (in Example 25) that tallow alcohol 18 EO alone in a 0.1% solution in demineralised water gives a streak-free result; this material, however, does not wet dirty glass very well. The composition of Example 41 was found to wet dirty glass moderately well and gave streak-free results on a dirty window as well as in the black tile test of Example 1.

EXAMPLE 42

A modification of the composition of Example 41 was prepared containing both anionic and nonionic surfactants and a film-forming resin as well as isopropanol and ammonia. The composition was as follows:

| | % |
|---|---|
| $C_{12}$—$C_{15}$ alkyl ether sulphate 3 EO (Empicol ESB 70 ex Albright & Wilson) | 0.1 |
| $C_9$—$C_{11}$ linear primary alcohol, 5 EO | 0.03 |

-continued

| | % |
|---|---|
| (Dobanol 91-5 ex Shell) | |
| Partially esterified resin (Scripset 550 ex Monsanto) | 0.01 |
| Isopropanol | 10.0 |
| Ammonia | to pH 10 |
| Demineralized water | to 100 |

This composition gave streak-free results in the test of Example 1. It also gave excellent results on glass soiled with a fatty soil, and on an external window.

EXAMPLE 43

The composition of Example 1 was modified by using a mixture of two nonionic surfactants and by adding a cellulosic material, Natrosol (Trade Mark) 250 g. The modified composition was as follows:

| | % |
|---|---|
| $C_9$—$C_{11}$ linear primary alcohol 5 EO (Dobanol 91-5) ex Shell) | 0.06 |
| Tallow alcohol 18 EO | 0.03 |
| Partially esterified resin (Scripset 550 ex Monsanto) | 0.01 |
| Hydroxyethyl cellulose with 2.5 moles of substituent combined (Natrosol 250 g) | 0.01 |
| Demineralised water | to 100 |

The pH was also adjusted to 9.0 with sodium hydroxide, to increase the cleaning power.

In the black tile test of Example 1 this composition gave excellent results.

EXAMPLE 44

A composition containing a relatively high proportion of a film-forming resin was prepared from the following ingredients:

| | % |
|---|---|
| Ammonium salt of 50% coconut fatty acid/ 50% oleic acid | 0.005 |
| Partially esterified resin (Scripset 550 ex Monsanto) | 0.1 |
| Demineralised water | to 100 |

In the black tile test of Example 1 this composition gave sreak-free results. When the demineralised water was replaced by water of 40° French hardness (32° Ca/8° Mg), however, heavy streaking occurred. This would appear to be caused by the reaction of the coconut/oleic soap and the partially esterified resin with the hardness ions to form streak-forming calcium and magnesium salts.

EXAMPLES 45–50

Six commercially available general purpose cleaning compositions based on mixtures of anionic and nonionic surfactants and containing builders were tested, at dilutions to approximately 0.1 to 0.2% in both demineralised and 40° FH water, by the procedure of Example 1. The compositions of these materials (before dilution) are given in Table 6.

The compositions of Examples 45 to 49 were all found to give substantially streak-free results in demineralised water, but to give appreciable streaking in hard water. It will be noted that all five contain phosphate builder. It is evident from the results in demineralised water that the builder itself is not detrimental to the streak-free effect, but the hard water results show that the reaction products of phosphate builders with hardness ions constitute streak-forming impurities.

The product of Example 50, however, behaved differently; on dilution with demineralised water it gave appreciable streaking, but when diluted with 40° FH water it gave substantially streak-free results. It would appear that one or more of the components used in this formulation are inherently streak-forming but interaction with hardness ions is able to promote substantially streak-free drying.

TABLE 6

| | EXAMPLES | | | | | |
|---|---|---|---|---|---|---|
| Component | 45 | 46 | 47 | 48 | 49 | 50 |
| Sodium alkyl benzene sulphonate | 3.5 | 10.5 | 7.5 | — | 8.0 | — |
| Sodium secondary alkane sulphonate | — | — | — | 9.0 | — | 4.5 |
| Fatty alcohol 6 EO | 2.0 | — | 1.5 | — | — | — |
| Fatty alcohol 8 EO | — | 2.0 | — | 2.5 | 2.0 | 2.0 |
| Sodium soap | 0.5 | — | 2.0 | — | 2.5 | 2.0 |
| Sodium tripolyphosphate | — | 5.0 | 3.0 | 4.5 | 5.0 | — |
| Potassium pyrophosphate | 6.5 | — | — | — | — | — |
| Sodium citrate | — | — | — | — | — | 3.2 |
| Sodium carbonate | — | — | — | — | — | 2.8 |
| Urea | 1.0 | 6.0 | — | — | — | — |
| Sodium xylene sulphonate | — | — | 1.5 | — | — | — |
| Sodium sulphate | — | — | — | — | — | 0.5 |
| Solvent | — | — | 6.0 | — | — | — |
| Ammonia | 0.5 | — | — | — | — | — |
| Monoethanolamine | — | — | — | — | 6.0 | — |
| Formaldehyde | — | — | — | — | 3.0 | — |
| water and minors to 100% | | | | | | |

COMPARATIVE EXAMPLE

The following composition containing a mixture of surfactants including a soap and a low cloud point nonionic surfactant, and also containing a phosphate builder, gave appreciable streaking when tested under the conditions of Example 1.

| | % |
|---|---|
| Alkylbenzene sulphonate | 0.02 |
| Coconut diethanolamide | 0.035 |
| Potassium salt of coconut fatty acid | 0.018 |
| Sodium tripolyphosphate | 0.01 |
| Demineralised water | to 100 |

The test was repeated using water of 40° French hardness (32° Ca, 8° Mg) and appreciable streaking still occurred.

We claim:

1. An article suitable for wiping hard surfaces to give a substantially streak-free result, said article comprising:

(a) a homogeneous aqueous liquid composition having a surface tension of less than 35 $mNm^{-1}$, which composition when applied to a surface and allowed to dry, dries substantially without the formation of discrete droplets or particles larger than 0.25 μm, said composition including at least one surface-active agent in a concentration not exceeding 1.5% by weight of total liquid composition;

(b) a substrate, for carrying said liquid composition, of a flexible sheet material selected from the group consisting of paper, woven, knitted and non-woven fabrics, the substrate being pre-washed with demineralized water or said homogeneous aqueous liquid composition;

the loading of the liquid composition (a) on the substrate (b) being within the range of from 0.5 to 10 grams per gram of substrate.

2. The article of claim 1, wherein the liquid composition (a) has a surface tension of less than 35 $mNm^{-1}$.

3. The article of claim 1, wherein the liquid composition (a), when applied to a surface and allowed to dry, dries substantially without forming discrete droplets or particles larger than 0.1 $\mu m$.

4. The article of claim 1, wherein the substrate (b) is impregnated with the composition (a).

5. The article of claim 1, wherein the substrate comprises at least one sheet of paper or woven, knitted or nonwoven fabric having a base weight of from 20 to 100 $g/m^2$.

6. The article of claim 5, wherein the substrate comprises a sheet having an area of at least 0.03 $m^2$.

7. The article of claim 5, wherein the loading of the liquid composition on the sheet substrate is from 0.5 to 3.0 times the base weight of the substrate.

8. The article of claim 1, wherein the liquid composition includes at least one nonionic surface-active agent.

9. The article of claim 1, wherein the liquid composition comprises at least one film-forming resin.

10. The article of claim 9, wherein the film-forming resin is an at least partially esterified resin.

11. The article of claim 9, wherein the concentration of film-forming resin(s) in the liquid composition is within the range of from 0.001 to 5% by weight.

12. The article of claim 9, wherein the liquid composition comprises one or more surface-active agents and one or more film-forming resins in a ratio of from 15:1 to 1:2.

13. The article of claim 1, wherein the liquid composition (a) comprises not more than 35% by weight of one or more non-aqueous water-miscible solvent(s).

14. The article of claim 13, which comprises a solvent selected the group consisting of from $C_2$ and $C_3$ aliphatic alcohols, cellosolves and carbitols.

15. A process for the production of the article of claim 1, which includes the steps of (i) prewashing the substrate (b) with a solvent capable of removing streak-free impurities therefrom, and (ii) applying to the prewashed substrate (b) the liquid cleaning composition (a).

16. The process of claim 15, wherein step (i) comprises washing the substrate in demineralised water.

17. The process of claim 15, wherein step (i) comprises washing the substrate in the liquid cleaning composition (a).

* * * * *